US011644029B2

(12) United States Patent
Takamizawa et al.

(10) Patent No.: US 11,644,029 B2
(45) Date of Patent: May 9, 2023

(54) FUEL INJECTION PUMP

(71) Applicant: DENSO CORPORATION, Kariya (JP)

(72) Inventors: Satoru Takamizawa, Kariya (JP); Tadaaki Makino, Kariya (JP)

(73) Assignee: DENSO CORPORATION, Kariya (JP)

( * ) Notice: Subject to any disclaimer, the term of this patent is extended or adjusted under 35 U.S.C. 154(b) by 254 days.

(21) Appl. No.: 16/993,751

(22) Filed: Aug. 14, 2020

(65) Prior Publication Data

US 2021/0054815 A1 Feb. 25, 2021

(30) Foreign Application Priority Data

Aug. 21, 2019 (JP) ..... JP2019-151460

(51) Int. Cl.

| | |
|---|---|
| ***F02M 59/02*** | (2006.01) |
| ***F02M 59/10*** | (2006.01) |
| ***F04B 15/00*** | (2006.01) |
| ***F04B 53/18*** | (2006.01) |

(52) U.S. Cl.

CPC ..... *F04B 53/18* (2013.01); *F02M 59/102* (2013.01); *F02M 2200/02* (2013.01)

(58) Field of Classification Search

CPC .... F04B 53/18; F02M 59/102; F02M 2200/02

USPC ..... 93/153

See application file for complete search history.

(56) References Cited

U.S. PATENT DOCUMENTS

| | | | | |
|---|---|---|---|---|
| 2,223,855 | A * | 12/1940 | Powell | B60F 3/0007 440/12.63 |
| 6,216,583 | B1 * | 4/2001 | Klinger | F02M 63/0001 123/90.35 |
| 6,435,150 | B1 * | 8/2002 | Loughlin | F01L 1/14 123/90.48 |
| 6,951,165 | B2 * | 10/2005 | Kuhn | F04B 1/0426 92/72 |
| 7,793,583 | B2 * | 9/2010 | Radinger | F01L 1/143 74/569 |
| 8,191,459 | B2 * | 6/2012 | Bauer | F02M 59/102 92/155 |
| 9,835,123 | B2 * | 12/2017 | Smith | F02M 59/44 |
| 9,885,330 | B1 * | 2/2018 | Xu | F02M 59/102 |
| 9,951,734 | B2 * | 4/2018 | Oki | F02M 59/025 |

(Continued)

FOREIGN PATENT DOCUMENTS

| | | |
|---|---|---|
| DE | 10 2006 057 246 | 11/2015 |
| DE | 10 2016 204 064 | 9/2017 |

(Continued)

*Primary Examiner* — Logan M Kraft
*Assistant Examiner* — John D Bailey
(74) *Attorney, Agent, or Firm* — Nixon & Vanderhye P.C.

(57) ABSTRACT

A fuel injection pump includes: a tappet configured to reciprocate by rotation of a cam; a cylinder that supports the tappet to reciprocate; and a plunger configured to reciprocate with the tappet. The tappet includes: a tappet body supported by the cylinder to reciprocate; a pin supported on both sides in an axial direction of the pin by the tappet body; a roller rotatably fitted to an outer peripheral side of the pin; a washer disposed between at least one end surface of the roller in the axial direction and an inner peripheral surface of the tappet body. The washer has at least one protrusion to be in contact with a stopper of the tappet body in either of two rotational directions.

13 Claims, 14 Drawing Sheets

(56) References Cited

U.S. PATENT DOCUMENTS

| | | | | |
|---|---|---|---|---|
| 2013/0133621 | A1* | 5/2013 | Jones | F01L 1/14 123/456 |
| 2014/0064993 | A1* | 3/2014 | Park | F04B 1/0426 417/364 |
| 2014/0150602 | A1* | 6/2014 | Hauvespre | F16H 25/14 29/895.2 |
| 2015/0082938 | A1* | 3/2015 | Schick | F01L 1/12 74/569 |
| 2015/0176691 | A1* | 6/2015 | Champalou | F02M 59/44 74/569 |
| 2015/0369097 | A1* | 12/2015 | Hauvespre | F04B 1/0413 74/559 |
| 2016/0222934 | A1 | 8/2016 | Oki | |
| 2017/0016418 | A1* | 1/2017 | Brune | F01L 1/08 |
| 2017/0074221 | A1* | 3/2017 | Shimogawa | F04B 53/18 |
| 2017/0159507 | A1* | 6/2017 | Viault | F16H 53/06 |
| 2017/0342951 | A1* | 11/2017 | Xu | F04B 1/0426 |
| 2018/0274647 | A1* | 9/2018 | Hauvespre | F04B 53/00 |
| 2019/0368455 | A1* | 12/2019 | Brune | F02M 59/44 |
| 2020/0041018 | A1* | 2/2020 | Geyer | F04B 1/053 |
| 2020/0284230 | A1* | 9/2020 | Takamizawa | F02M 59/462 |
| 2020/0370524 | A1* | 11/2020 | Dutt | F02M 59/44 |

FOREIGN PATENT DOCUMENTS

| | | |
|---|---|---|
| DE | 10 2017 120 884 | 10/2018 |
| JP | 62-22324 | 2/1987 |
| JP | 63-61509 | 4/1988 |

* cited by examiner

FUEL INJECTION PUMP

CROSS REFERENCE TO RELATED APPLICATION

This application is based on Japanese Patent Application No. 2019-151460 filed on Aug. 21, 2019, the disclosure of which is incorporated herein by reference in its entirety.

TECHNICAL FIELD

The present disclosure relates to a fuel injection pump.

BACKGROUND

A fuel injection pump pressurizes and supplies fuel to an injector by rotation of a cam to make a plunger to reciprocate. A tappet is known to convert the rotation of the cam into a reciprocating movement of the plunger.

SUMMARY

According to an aspect of the present disclosure, a fuel injection pump includes: a tappet that reciprocates by rotation of a cam; a cylinder that supports the tappet reciprocally; and a plunger that reciprocates together with the tappet to discharge the pressurized fuel. The tappet includes a tappet body, a pin, a roller, and a washer. The tappet body is supported by the cylinder so as to be capable of reciprocating. The pin is supported by the tappet body at both sides in the axial direction. The roller is rotatably fitted to the outer peripheral side of the pin, and is rotated by the rotation of the cam to reciprocally move to make the plunger and the tappet body to reciprocate. The washer is installed between at least one axial end surface of the roller and the inner peripheral surface of the tappet body. The washer has at least one protrusion to be in contact with a stopper of the tappet body in one of two rotational directions. The rotation is stopped by the protrusion hitting the stopper.

DETAILED DESCRIPTION

Figure 1:
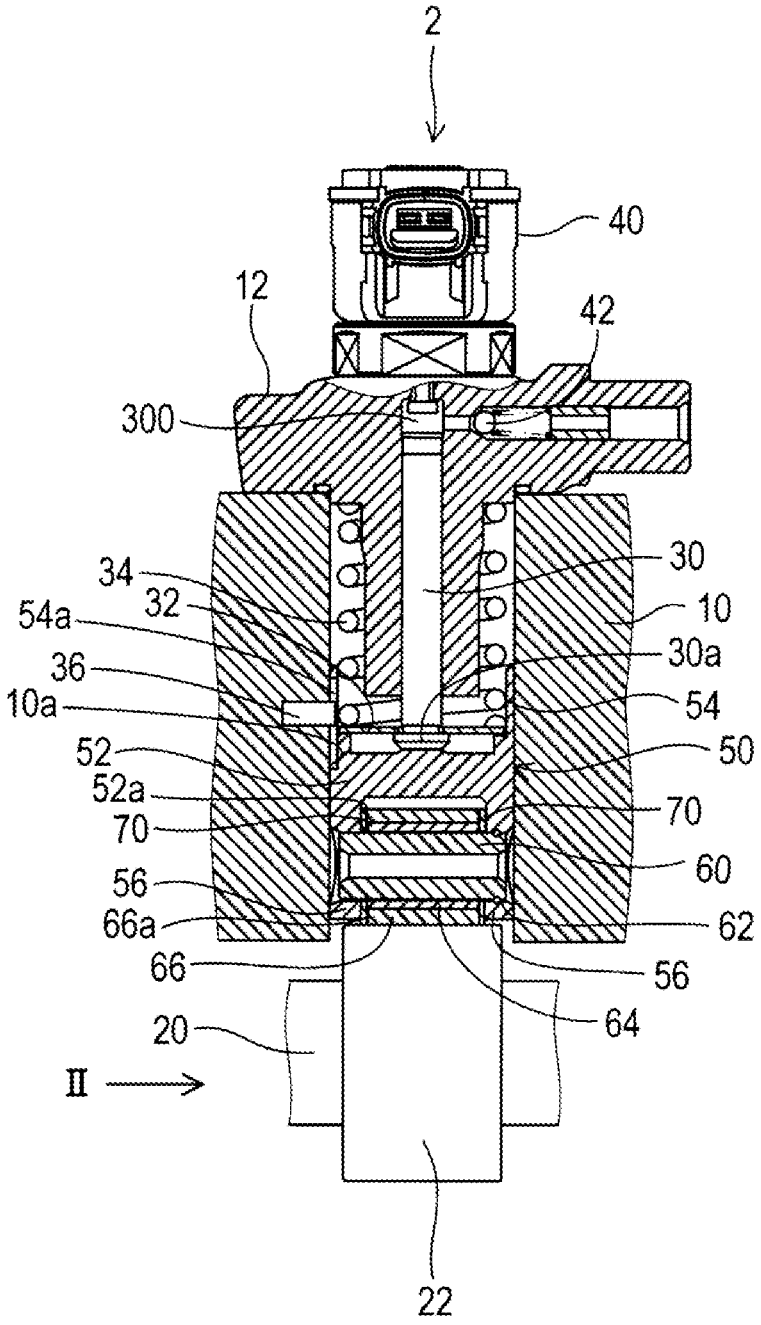
FIG. 1 is a sectional view illustrating a fuel injection pump according to a first embodiment.

To begin with, examples of relevant techniques will be described.

A fuel injection pump pressurizes and supplies fuel to an injector by rotation of a cam to make a plunger to reciprocate. A tappet is known to convert the rotation of the cam into a reciprocating movement of the plunger.

A tappet includes: a tappet body supported by a cylinder to reciprocate; a roller arranged adjacent to a cam; and a pin that rotatably supports the roller. When the cam rotates, the roller rotates and reciprocates to make the plunger and tappet to reciprocate.

Further, a washer is disposed between the inner peripheral surface of the tappet body and the axial end surface of the roller to restrict wear of the inner peripheral surface of the tappet body and the axial end surface of the roller by the rotation of the roller.

However, an axial force may be applied to a camshaft due to vibration of the engine, a structure for transmitting the driving force of the engine to the camshaft, or the like. When an axial force is applied to the camshaft, an axial force is also applied to the roller that rotates while contacting the cam, so that the axial end surface of the roller is pressed against the washer. As a result, due to the resistance of the contact surface between the washer and the roller, when the roller rotates, the washer may rotate together while being pressed against the inner peripheral surface of the tappet body.

The rotation of the washer is not considered in the relevant techniques. As a result of detailed study by the inventors, it was found that the inner peripheral surface of the tappet body is worn when the washer rotates while being pressed against the inner peripheral surface of the tappet body by the rotation of the roller.

The present disclosure provides a fuel injection pump in which a washer arranged between an inner peripheral surface of a tappet body and an axial end surface of a roller is restricted from rotating.

According to an aspect of the present disclosure, a fuel injection pump includes: a tappet that reciprocates by rotation of a cam; a cylinder that supports the tappet reciprocally; and a plunger that reciprocates together with the tappet to discharge the pressurized fuel.

The tappet includes a tappet body, a pin, a roller, and a washer.

The tappet body is supported by the cylinder so as to be capable of reciprocating. The pin is supported by the tappet body at both sides in the axial direction. The roller is rotatably fitted to the outer peripheral side of the pin, and is rotated by the rotation of the cam to reciprocally move to make the plunger and the tappet body to reciprocate.

The washer is installed between at least one axial end surface of the roller and the inner peripheral surface of the tappet body. The washer has at least one protrusion to be in contact with a stopper of the tappet body in one of two rotational directions. The rotation is stopped by the protrusion hitting the stopper.

According to this structure, even if the washer tries to rotate due to the rotation of the roller, the protrusion of the washer contacts the stopper of the tappet body, so that the rotation of the washer is stopped. As a result, even if the roller rotates, the washer does not rotate with respect to the inner peripheral surface of the tappet body, so that wear of the inner peripheral surface of the tappet body can be suppressed.

Hereinafter, embodiments will be described with reference to the drawings.

First Embodiment

A fuel injection pump 2 shown in FIG. 1 supplies pressurized fuel to a common rail (not shown). A pump housing of the fuel injection pump 2 includes a housing body 10 and a cylinder head 12. The housing body 10 bears a camshaft 20. The cylinder head 12 supports a plunger 30 to be capable of reciprocating.

Figure 2:
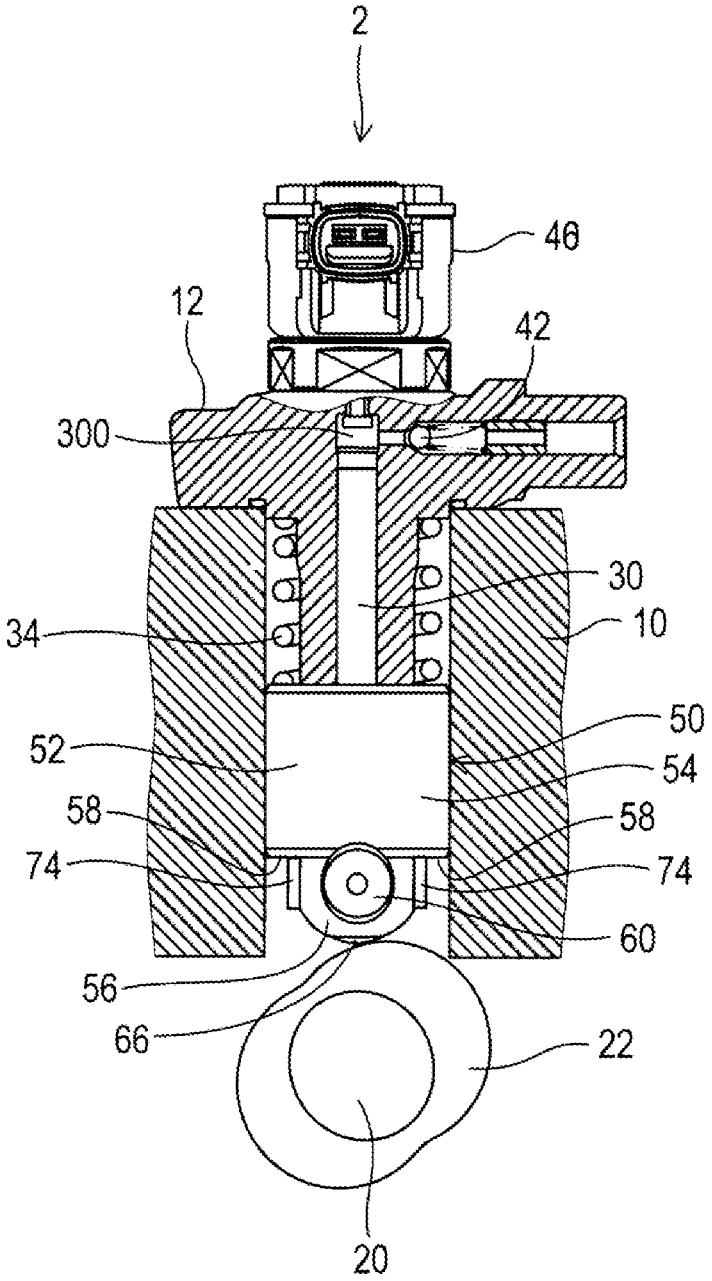
FIG. 2 is a view seen in an arrow direction II in FIG. 1.

A pressurizing chamber 300 is formed on the opposite side of the plunger 30 opposite to the cam 22. Fuel is supplied to the pressurizing chamber 300 from a feed pump (not shown). As shown in FIG. 2, the camshaft 20 has a cam 22 having a double-edged cam profile defined by a continuous curve.

A metering valve 40 and a discharge valve 42 are installed in the cylinder head 12. The metering valve 40 is a solenoid valve, and controls the flow rate of fuel discharged from the discharge valve 42 by closing at a predetermined timing of the compression stroke by the plunger 30. The discharge valve 42 opens when the fuel pressure in the pressurizing chamber 300 becomes equal to or higher than a predetermined pressure in the compression stroke, and discharges the fuel in the pressurizing chamber 300 from the fuel injection pump 2.

As shown in FIG. 1, a plunger head 30*a* of the plunger 30 is attached to a tappet body 52 of the tappet 50 by a seat member 32. The tappet 50 receives a load toward the cam 22 due to the load received from a spring 34.

As shown in FIGS. 1 and 2, the tappet 50 includes the tappet body 52, a pin 60, a C-ring 62, a bush 64, a roller 66, and a washer 70.

Figure 3:
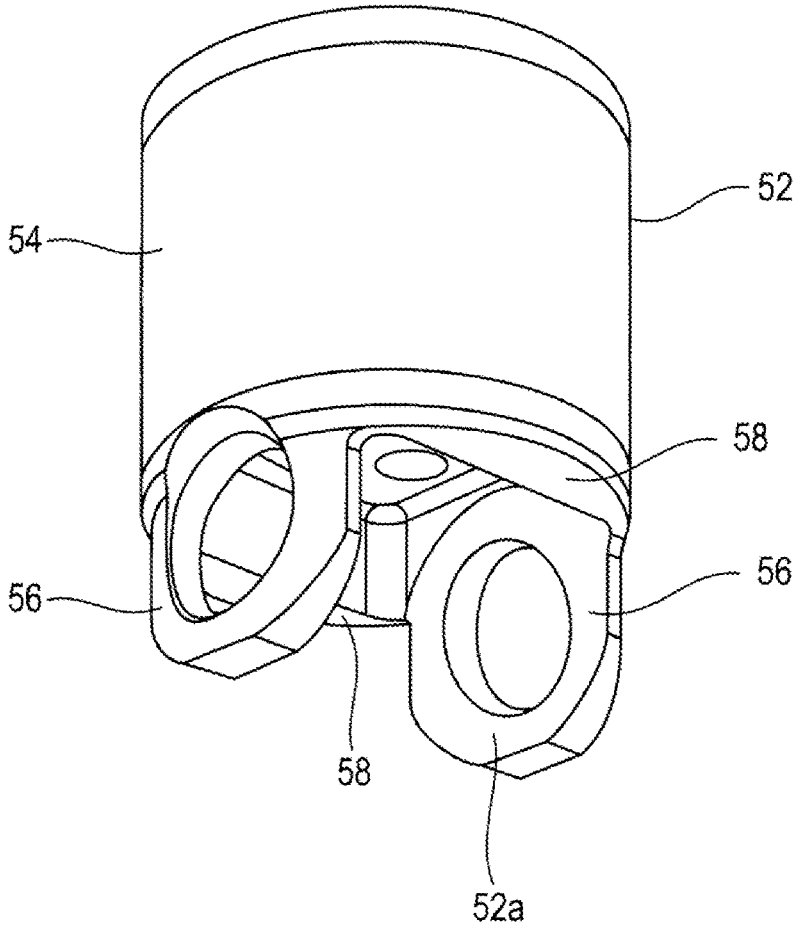
FIG. 3 is a perspective view illustrating a tappet body.

As shown in FIG. 3, the tappet body 52 includes a cylindrical portion 54 that is reciprocally supported by the cylinder portion 10*a* of the housing body 10, a support portion 56 that supports both ends of the pin 60 in the axial direction, and a stopper 58 for stopping the rotation of the washer 70.

Figure 5:
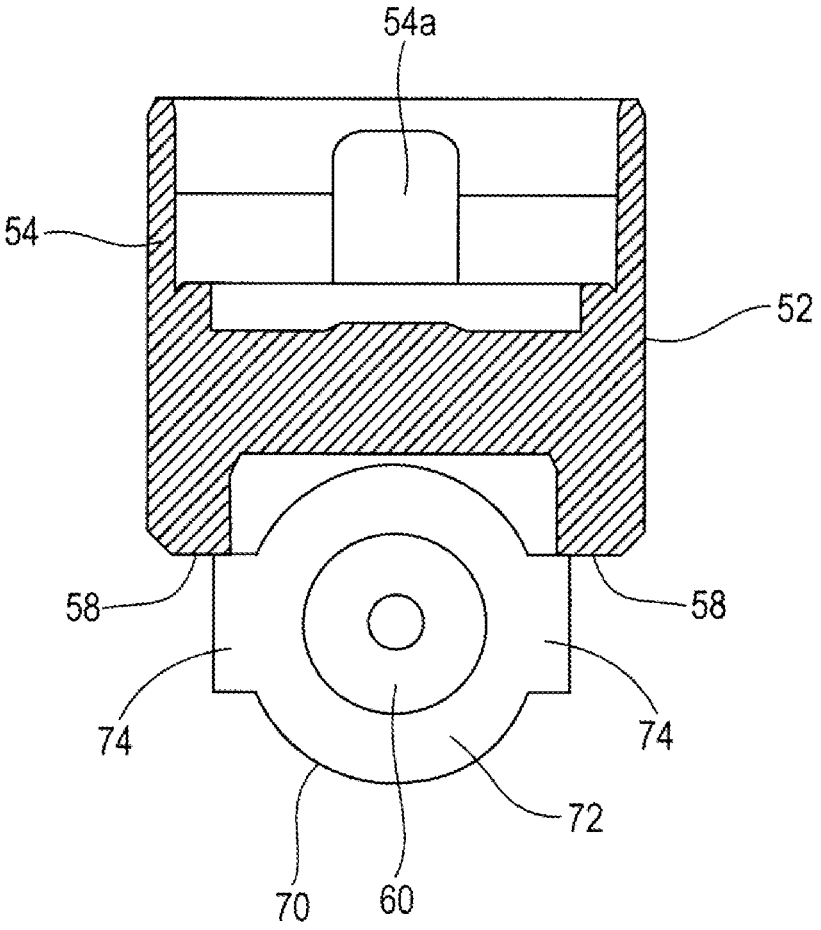
FIG. 5 is a sectional view in which the washer is restricted from rotating by the tappet body.

As shown in FIGS. 1 and 5, the cylindrical portion 54 has a fitting hole 54*a* into which a detent pin 36 is fitted. The tappet body 52 is restricted from rotating by the fitting of the detent pin 36 into the fitting hole 54*a* of the cylindrical portion 54.

Both ends of the pin 60 in the axial direction are rotatably supported by the support portion 56 of the tappet body 52, or the pin 60 is supported by the tappet body 52 by being fixed to the support portion 56 with press-fitting.

An annular groove is formed on the outer peripheral surface of one axial end of the pin 60. An annular groove is also formed on the inner peripheral surface of the support portion 56 of the tappet body 52 so as to be aligned with the annular groove formed on the pin 60 in the axial position. The C-ring 62 is fitted into the annular groove formed on the outer peripheral surface of the pin 60 and the inner peripheral surface of the support portion 56 of the tappet body 52, whereby the axial movement of the pin 60 is suppressed.

The bush 64 is formed in a cylindrical shape, and is fitted on the outer peripheral side of the pin 60. The roller 66 is formed in a cylindrical shape, and is rotatably supported by the bush 64 by being fitted to the outer peripheral side of the bush 64. The outer peripheral surface of the roller 66 is in contact with the outer peripheral surface of the cam 22. With the rotation of the cam 22, the roller 66 rotating in contact with the outer peripheral surface of the cam 22 reciprocates, so that the tappet 50 and the plunger 30 also reciprocate.

The washer 70 is formed in an annular and flat plate shape, and the inner circumference of the washer 70 is supported by the pin 60 by being fitted to the outer periphery of the pin 60. The washer 70 is provided on both sides of the roller 66 in the axial direction. The washer 70 is located between the inner peripheral surface 52*a* of the tappet body 52 and the axial end surface of the bush 64, and is located between the inner peripheral surface 52*a* of the tappet body 52 and the axial end surface 66*a* of the roller 66.

As shown in FIGS. 2 and 5, both ends of the washer 70 are located at the inner side of the both ends of the tappet body 52 in the radial direction of the tappet body 52.

Figure 4:
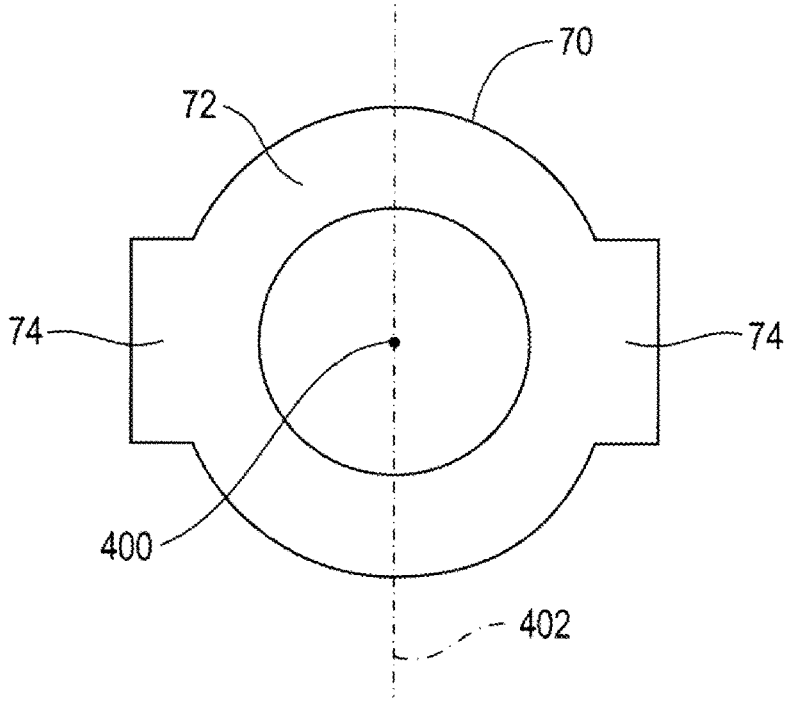
FIG. 4 is a view illustrating a washer.

As shown in FIG. 4, the washer 70 has an annular portion 72 having an annular shape and two protrusions 74. The protrusion 74 protrudes outward in the radial direction from the annular portion 72, at both sides of the annular portion 72 in the radial direction. The washer 70 has an axis 402 that passes through the center 400 of the washer 70. The axis 402 is a symmetrical axis that divides the two protrusions 74 to a left side and a right side. That is, the washer 70 has a symmetrical shape between the left side and the right side of the axis 402.

The washer 70 is installed between the inner peripheral surface 52*a* of the tappet body 52 and the axial end surface 66*a* of the roller 66, so that the axial end surface 66*a* of the roller 66 is restricted from contacting the inner peripheral surface 52*a* of the tappet body 52. Accordingly, even if the roller 66 rotates due to the rotation of the cam 22, the inner peripheral surface 52*a* of the tappet body 52 can be restricted from being worn due to the rotation of the roller 66.

When an axial force is applied to the camshaft 20 due to the vibration of the engine, the structure for transmitting the driving force of the engine to the camshaft 20, or the like, the axial force is also applied to the roller 66 rotating in contact with the cam 22. At this time, the axial end surface 66*a* of the roller 66 is pressed against the washer 70.

As a result, when the roller 66 is rotated by the rotation of the cam 22, the washer 70 in contact with the axial end surface 66*a* of the roller 66 receives a force in the rotational direction. In this case, even if the washer 70 receives a force in either of the two rotational directions, as shown in FIG. 5, the protrusion 74 of the washer 70 hits the stopper 58 of the tappet body 52 in the rotational direction, so that the rotation of the washer 70 is stopped.

In order to restrict the roller 66 and the washer 70 from being worn by the rotation of the roller 66 in FIG. 1, at least one of the contact surface of the roller 66 and the contact surface of the washer 70 may have a coating having abrasion resistance property, such as diamond like carbon (DLC) or poly tetra fluoro ethylene (PTFE).

The first embodiment described above produces the following effects.

(1*a*) Since the protrusion 74 of the washer 70 hits the stopper 58 of the tappet body 52 in the rotational direction to stop the rotation of the washer 70, the inner peripheral surface 52*a* of the tappet body 52 in contact with the washer 70 can be restricted from being worn by the rotation of the washer 70.

(1*b*) Since the washer 70 has the protrusion 74 on both sides of the annular portion 72 in the radial direction, the protrusion 74 of the washer 70 hits the stopper 58 of the body 52 when the roller 66 rotates in either of two rotational directions. Accordingly, the rotation of the washer 70 can be stopped even if the roller 66 rotates in either of the two rotational directions.

(1*c*) Since the both ends of the washer 70 are located at the radially inner side of the both ends of the tappet body 52 in the radial direction of the tappet body 52, the washer 70 can be restricted from interfering with the cylinder portion 10*a* that supports the tappet body 52.

Second Embodiment

The fundamental configuration of the second embodiment is similar to that of the first embodiment, so the difference therebetween will be described below. Note that the same reference numerals as those in the first embodiment indicate the same configuration, and refer to the preceding descriptions.

Figure 6:
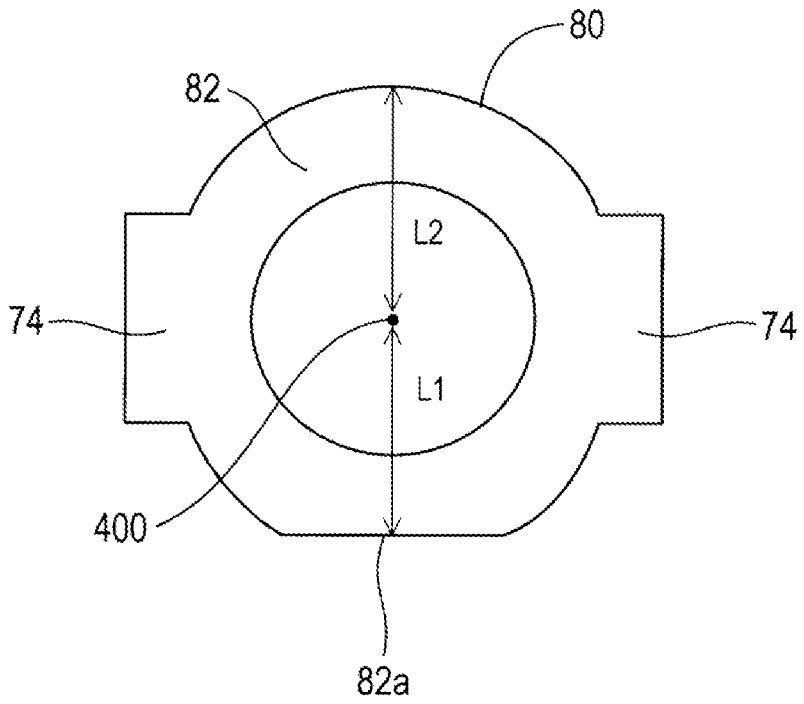
FIG. 6 is a view illustrating a washer according to a second embodiment.

In the first embodiment, the annular portion 72 of the washer 70 has the fixed diameter. In the second embodiment shown in FIG. 6, a notch 82*a* is formed on the annular portion 82 of the washer 80 at a location adjacent to the cam 22 while the annular portion 82 of the washer 80 opposite from the cam 22 is circular. In other words, the diameter of the annular portion 82 of the washer 80 differs between one side adjacent to the cam 22 and the opposite side opposite from the cam 22.

With this configuration, in the second embodiment, the length L1 from the center 400 of the washer 80 to an end position of the washer 80 adjacent to the cam 22 is shorter than the length L2 from the center 400 of the washer 80 to the other end position of the washer 80 opposite from the cam 22.

According to the second embodiment described above, the effects (1*a*) to (1*c*) of the first embodiment can be obtained by replacing the washer 70 with the washer 80 and replacing the annular portion 72 with the annular portion 82. Moreover, further following effects can be obtained.

(2*a*) Since the notch 82*a* is formed at the location adjacent to the cam 22, it is possible to restrict the washer 80 from coming into contact with the cam 22.

Third Embodiment

The fundamental configuration of the third embodiment is similar to that of the second embodiment, so the difference therebetween will be described below. Note that the same reference numerals as those in the second embodiment indicate the same configuration, and refer to the preceding descriptions.

In the second embodiment, the notch 82*a* is formed on the washer 80 at the location adjacent to the cam 22, such that the length L1 from the center 400 of the washer 80 to the end position adjacent to the cam 22 is shorter than the length L2 from the center 400 of the washer 80 to the other end position opposite from the cam 22.

Figure 7:
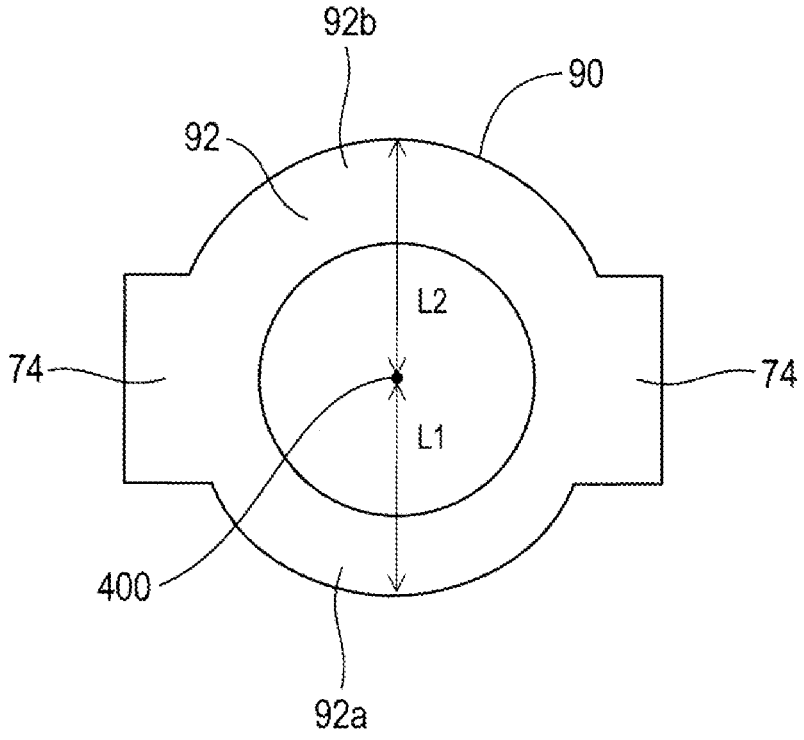
FIG. 7 is a view illustrating a washer according to a third embodiment.

In the third embodiment shown in FIG. 7, since the diameter of the small diameter portion 92*a* of the annular portion 92 of the washer 90 adjacent to the cam 22 is smaller than the diameter of the large diameter portion 92*b* of the annular portion 92 of the washer 90 opposite from the cam 22, such that the length L1 from the center 400 of the washer 90 to the end position adjacent to the cam 22 is shorter than the length L2 from the center 400 of the washer 90 to the other end position opposite from the cam 22.

According to the third embodiment described above, the effects (1*a*) to (1*c*) of the first embodiment can be obtained in which the washer 70 is replaced with the washer 90 and the annular portion 72 is replaced with the annular portion 92. Moreover, following further effects can be obtained.

(3*a*) Since the diameter of the small diameter portion 92*a* of the annular portion 92 adjacent to the cam 22 is smaller than the diameter of the large diameter portion 92*b* at location opposite from the cam 22, the washer 90 can be suppressed from contacting the cam 22.

Fourth Embodiment

The fundamental configuration of the fourth embodiment is similar to that of the first embodiment, so the difference therebetween will be described below. Note that the same reference numerals as those in the first embodiment indicate the same configuration, and refer to the preceding descriptions.

Figure 8:
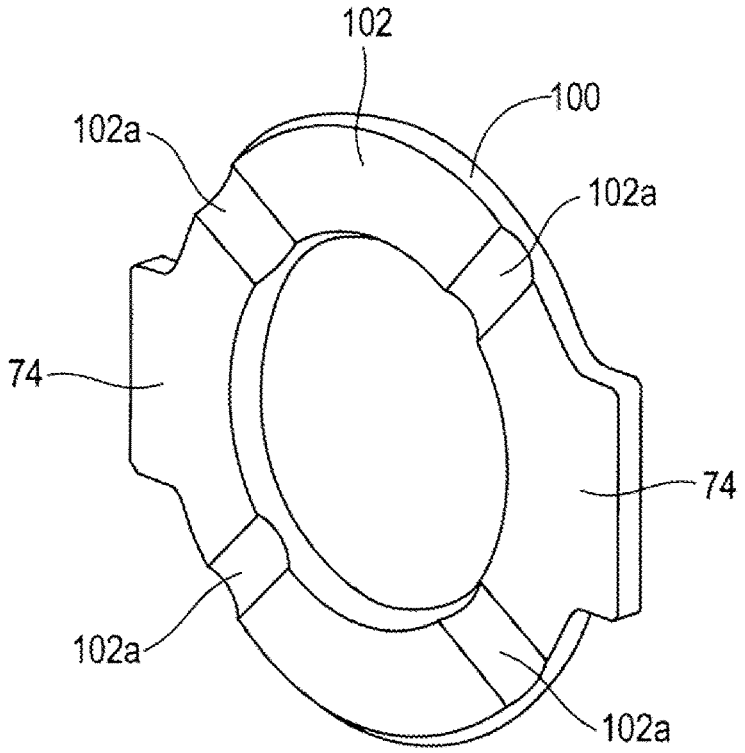
FIG. 8 is a perspective view illustrating a washer according to a fourth embodiment.

In the first embodiment, both end surfaces of the annular portion 72 of the washer 70 in the thickness direction are formed in flat shape. In the fourth embodiment shown in FIG. 8, four grooves 102*a* are formed on a contact surface of the annular portion 102 of the washer 100 in contact with the roller 66, at 90 degrees intervals. The groove 102*a* extends in the radial direction of the annular portion 102.

According to the fourth embodiment described above, the effects (1*a*) to (1*c*) of the first embodiment can be obtained by replacing the washer 70 with the washer 100 and replacing the annular portion 72 with the annular portion 102. Moreover, following further effects can be obtained.

(4*a*) Since the groove 102*a* is formed along the radial direction of the annular portion 102, it is easy for lubricating oil to enter while the roller 66 and the washer 100 are in contact with each other. This can restrict the contact surface between the roller 66 and the washer 100 from being worn.

Fifth Embodiment

The fundamental configuration of the fifth embodiment is similar to that of the first embodiment, so the difference therebetween will be described below. Note that the same reference numerals as those in the first embodiment indicate the same configuration, and refer to the preceding descriptions.

In the first embodiment, the protrusion 74 protruding radially outward from the annular portion 72 on both sides in the radial direction of the annular portion 72 of the washer 70 hits the stopper 58 of the tappet body 52 in both rotational directions, whereby the rotation of the washer 70 is stopped.

Figure 9:
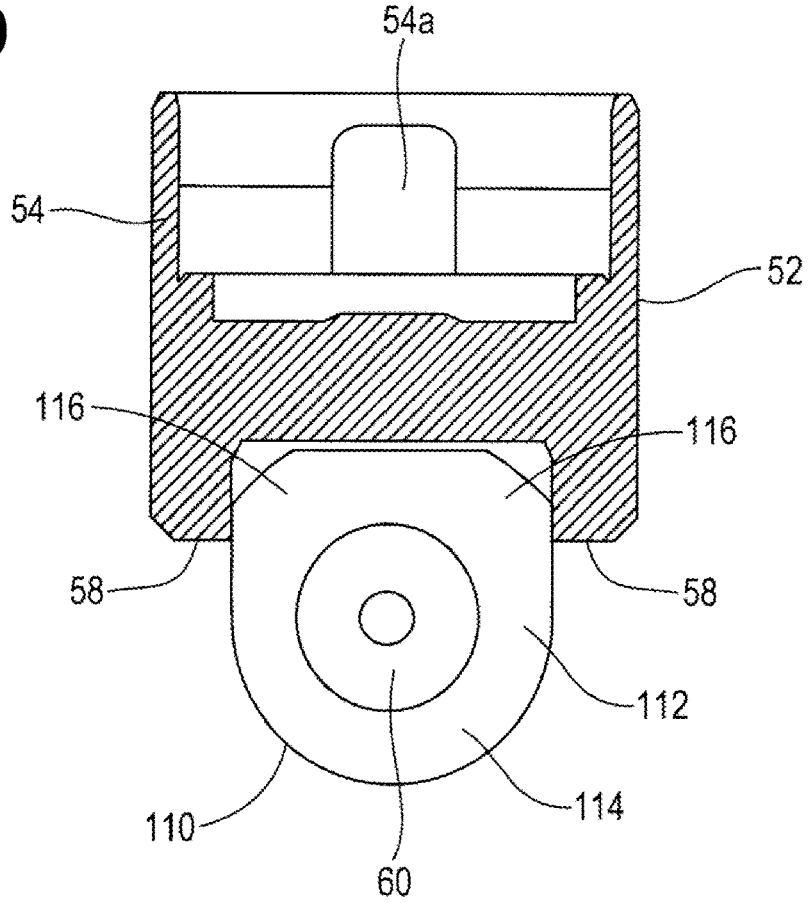
FIG. 9 is a sectional view in which a washer is restricted from rotating by a tappet body according to a fifth embodiment.

In contrast, in the fifth embodiment shown in FIG. 9, a ring portion 114 is formed on the annular portion 112 of the washer 110 adjacent to the cam 22, and a protrusion 116 is formed on the annular portion 112 at a location opposite from the cam 22. The protrusion 116 protrudes radially outward, toward the inner peripheral side of the stopper 58 of the tappet body 52. The protrusion 116 abuts on the inner peripheral surface of the stopper 58 of the tappet body 52 in both rotational directions.

According to the fifth embodiment described above, the effects (1*a*) to (1*c*) of the first embodiment can be obtained in which the washer 70 is replaced with the washer 110, the annular portion 72 is replaced with the annular portion 112, and the protrusion 74 is replaced with the protrusion 116.

Sixth Embodiment

The fundamental configuration of the sixth embodiment is similar to that of the first embodiment, so the difference therebetween will be described below. Note that the same reference numerals as those in the first embodiment indicate the same configuration, and refer to the preceding descriptions.

In the first embodiment, the protrusion 74 protruding radially outward from the annular portion 72 on both sides in the radial direction of the annular portion 72 of the washer 70 hits the stopper 58 of the tappet body 52 in both rotational directions, whereby the rotation of the washer 70 is stopped.

Figure 10:
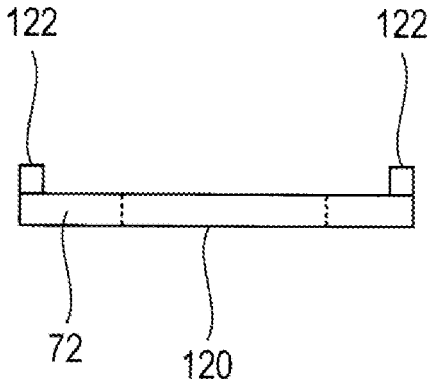
FIG. 10 is a side view illustrating a washer according to a sixth embodiment.

In the sixth embodiment shown in FIG. 10, a protrusion 122 is formed to protrude from the annular portion 72 of the washer 120 to one side in the thickness direction, at both sides in the radial direction. The protrusion 122 hits a stopper (not shown) of a tappet body in both rotational directions.

According to the sixth embodiment described above, the effects (1*a*) to (1*c*) of the first embodiment can be obtained in which the washer 70 is read as the washer 120, and the protrusion 74 protruding radially outward from the annular portion 72 is read as the protrusion 122 protruding from the annular portion 72 to one side in the thickness direction.

Seventh Embodiment

The fundamental configuration of the seventh embodiment is similar to that of the first embodiment, so the difference therebetween will be described below. Note that the same reference numerals as those in the first embodiment indicate the same configuration, and refer to the preceding descriptions.

Figure 11:
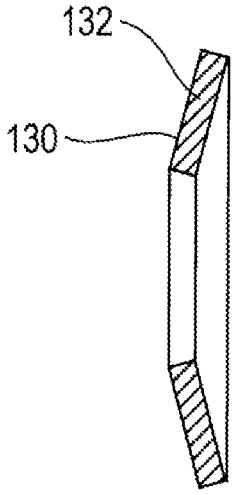
FIG. 11 is a sectional view illustrating a washer according to a seventh embodiment.

In the first embodiment, the washer 70 is formed in a flat plate shape. In the seventh embodiment shown in FIG. 11, the washer 130 is formed in a disc spring shape. Specifically, the washer 130 has a protrusion (not shown) protruding radially outward from the annular portion 132 on both sides in the radial direction of the annular portion 132. Since the washer 130 is formed in a disc spring shape, the washer 130 is formed to produce an elastic force in the thickness direction.

According to the seventh embodiment described above, the effects (1*a*) to (1*c*) of the first embodiment can be obtained by replacing the washer 70 with the washer 130 and replacing the annular portion 72 with the annular portion 132. Moreover, following further effects can be obtained.

(7*a*) Since the washer 130 is elastic in the thickness direction, even if the washer 130 is pressed onto the inner peripheral surface 52*a* of the tappet body 52 by the roller 66 to deform the washer 130 into a flat plate shape, the washer 130 returns to the disc spring shape due to the elastic force when the force pressing the washer 130 against the peripheral surface 52*a* decreases.

Accordingly, the washer 130 and the axial end surface 66*a* of the roller 66 can be restricted from coming into close contact with each other, so that the rotational force of the roller 66 applied to the washer 130 can be reduced.

Eighth Embodiment

The fundamental configuration of the eighth embodiment is similar to that of the first embodiment, so the difference therebetween will be described below. Note that the same reference numerals as those in the first embodiment indicate the same configuration, and refer to the preceding descriptions.

In the first embodiment, the axis 402 of the washer 70 passing through the center 400 serves as a symmetry axis for the two protrusions 74 formed on both, e.g., left and right, sides in the radial direction. The shape of the washer 70 is the same between the both sides in the radial direction.

Figure 12:
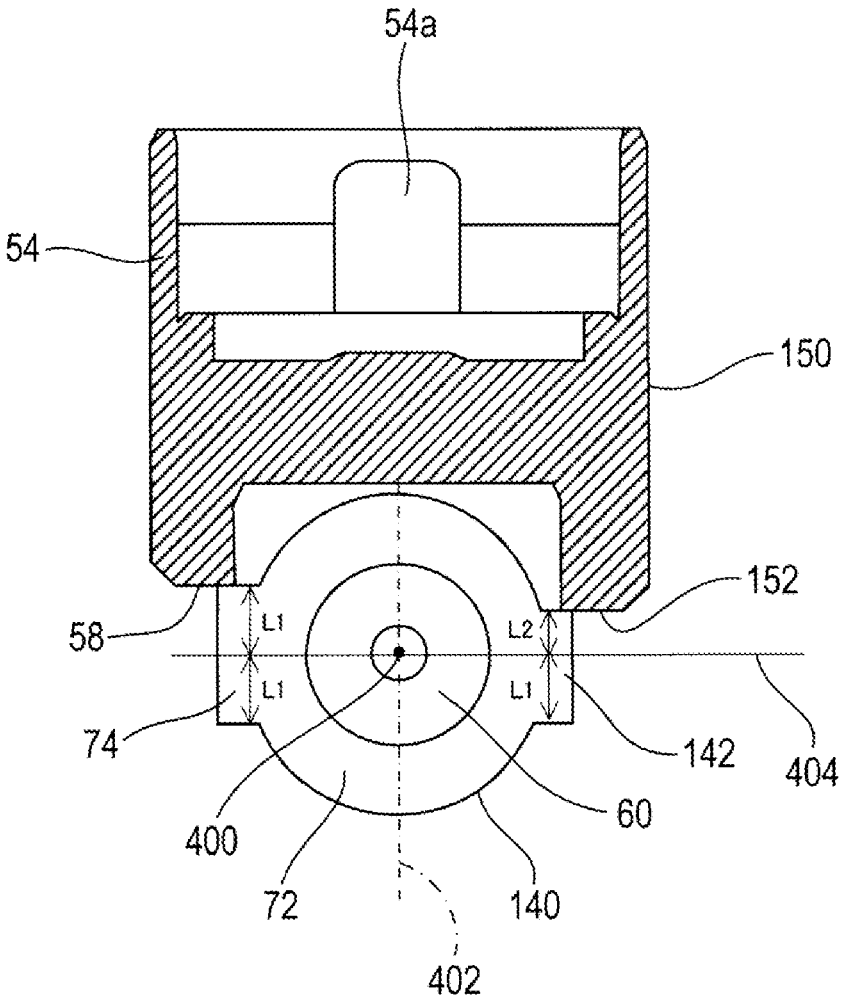
FIG. 12 is a sectional view in which a washer is restricted from rotating by a tappet body according to an eighth embodiment.

In the eighth embodiment shown in FIG. 12, the washer 140 has a protrusion 74 on one side and a protrusion 142 on the other side in the radial direction with respect to the axis 402 corresponding to the washer 70 of the first embodiment. In other words, the shape of the washer 140 is different between the one side and the other side in the radial direction. That is, the outer shape of the washer 140 viewed from the roller 66 is different from the outer shape of the washer 140 viewed from the opposite side of the roller 66.

Specifically, a length L1 from an axis 404 passing through the center 400 of the washer 140 and orthogonal to the axis 402 to one end in the width direction of the protrusion 74, a length L1 from the axis 404 to the other end of the protrusion 74 in the width direction, and a length L1 from the axis 404 to one end of the protrusion 142 adjacent to the cam 22 in the width direction are the same. A length L2 from the axis 404 to the other end of the protrusion 142 opposite to the cam 22 in the width direction is shorter than the length L1.

In accordance with the configuration of the protrusions 74 and 142, the stopper 152 of the tappet body 150 that stops the movement of the protrusion 142 in the rotational direction extends toward the cam 22 more than the stopper 58 that stops the movement of the protrusion 74 in the rotational direction.

According to the eighth embodiment described above, the following further effects can be obtained in addition to the effects (1*a*) to (1*c*) of the first embodiment, in which the washer 70 is replaced with the washer 140, the protrusion 74 is replaced with the protrusions 74 and 142, and the stopper 58 is replaced with the stoppers 58 and 152.

(8*a*) The washer 140 has different shapes between one side and the other side in the radial direction, and the outer shape of the washer 140 viewed from the roller 66 and the outer shape of the washer 140 viewed from the opposite side of the roller 66 are different. The extension length of the stopper 152 toward the cam is longer than that of the stopper 58 in accordance with the configuration of the protrusions 74 and 142 formed on the washer 140.

The washer 140 cannot be assembled to the pin 60 when the orientation of the washer 140 is reversed from the state shown in FIG. 12. Therefore, for example, when the surface of the washer 140 in contact with the roller 66 is mirror-finished or coated to suppress wear, the unprocessed surface can be restricted from being mistakenly assembled to face the roller 66.

Ninth Embodiment

The fundamental configuration of the ninth embodiment is similar to that of the eighth embodiment, so the difference therebetween will be described below. Note that the same reference numerals as those in the eighth embodiment indicate the same configuration, and refer to the preceding descriptions.

In the eighth embodiment, the length L1 from the axis 404 orthogonal to the axis 402 of the washer 140 to both ends of the protrusion 74 in the width direction and the length L1 from the axis 404 to one end of the protrusion 142 adjacent to the cam 22 in the width direction are set as the same length. The length L2 from the axis 404 to the side of the protrusion 142 opposite from the cam 22 in the width direction is made shorter than the length L1. Thereby, in the eighth embodiment, the outer shape of the washer 140 viewed from the roller 66 and the outer shape of the washer 140 viewed from the opposite side of the roller 66 are different from each other.

Figure 13:
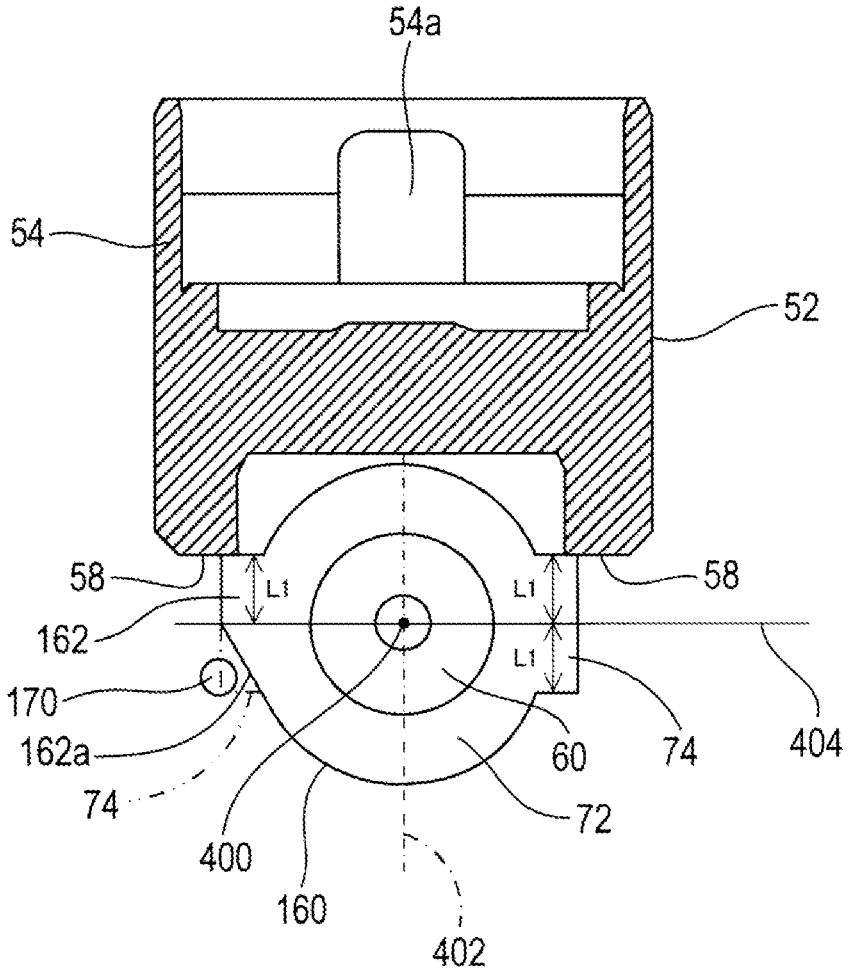
FIG. 13 is a sectional view in which a washer is restricted from rotating by a tappet body according to a ninth embodiment.

In the ninth embodiment shown in FIG. 13, of the protrusions 74 and 162, the protrusion 162 is notched at the side adjacent to the cam 22, so that the outer shape of the washer 160 seen from the roller 66 is different from the outer shape of the washer 160 viewed from the side opposite from the roller 66.

Specifically, the protrusion 162 has a notch 162*a* that is partially cut at location adjacent to the cam 22. The length L1 from the axis 404 passing through the center 400 of the washer 160 and orthogonal to the axis 402 to both ends of the protrusion 74 in the width direction, and the length L1 from the axis 404 to the side of the protrusion 162 opposite from the cam 22 in the width direction are the same length.

Therefore, the two stoppers 58 that come into contact with the protrusions 74 and 162 respectively to stop the rotation of the washer 160 have the same distance from the axis 404 on the side facing the cam 22. That is, the tappet body 52 of the ninth embodiment is substantially the same as the tappet body 52 of the first embodiment, unlike the eighth embodiment.

When assembling the pin 60, the bush 64, the roller 66, the washer 160, and the tappet body 52, an assembling housing (not shown) is used. As shown in FIG. 13, an assembly pin 170 is installed so as to project toward a position corresponding to the notch 162*a* of the protrusion 162 when the washer 160 is assembled normally.

When the washer 160 is normally assembled from the normal side such as front side, since the notch 162*a* of the protrusion 162 and the assembly pin 170 do not interfere with each other. Thus, the pin 60, the bush 64, the roller 66, the washer 160, and the tappet body 52 can be normally assembled.

If the washer 160 is erroneously assembled from the back side opposite from the front side such that the protrusion 162 and the protrusion 74 are reversed, the protrusion 74 interferes with the assembly pin 170 as indicated by a double chain line in FIG. 13. In case where the bush 64, the roller 66, and the washer 160 are assembled to the tappet body 52 so that the washer 160 does not interfere with the assembly pin 170, the position of the fitting hole of the washer 160 is misaligned relative to the position of the fitting hole of the support portion 56 of the tappet body 52 into which the pin 60 is inserted.

As a result, the pin 60 cannot be inserted into the fitting hole of the washer 160 through the fitting hole of the support portion 56 of the tappet body 52.

According to the ninth embodiment described above, the effects (1*a*) to (1*c*) of the first embodiment can be obtained in which the washer 70 is replaced with the washer 160, and the protrusion 74 is replaced with the protrusions 74 and 162. Moreover, the following further effects can be obtained.

(9*a*) Of the two protrusions 74 and 162 of the washer 160, the protrusion 162 is notched at location adjacent to the cam 22 compared with the protrusion 74. Therefore, the outer shape of the washer 160 seen from the roller 66 is different from the outer shape of the washer 160 seen from the side opposite to the roller 66.

Therefore, if the front side and the back side of the washer 160 are reversed in the state shown in FIG. 13, the pin 60, the bush 64, the roller 66, the washer 160, and the tappet body 52 cannot be assembled. Therefore, for example, when a surface of the washer 160 in contact with the roller 66 is mirror-finished or coated to suppress wear, the unprocessed surface can be restricted from being mistakenly assembled to face the roller 66.

(9*b*) The length L1 from the axis 404 to both ends of the protrusion 74 of the washer 160 in the width direction and the length L1 from the axis 404 to the side of the protrusion 162 opposite to the cam 22 in the width direction are the same length. As a result, the distance from the axis 404 to the stopper 58 facing the cam 22 to stop the rotation of the washer 160 by hitting the protrusions 74 and 162 respectively can be the same, so that the shape of the stopper 58 of the tappet body 52 can be made simple.

Tenth Embodiment

The fundamental configuration of the tenth embodiment is similar to that of the first embodiment, so the difference therebetween will be described below. Note that the same reference numerals as those in the first embodiment indicate the same configuration, and refer to the preceding descriptions.

In the first embodiment, the washer 70 is formed in a flat plate shape with the same thickness. In the tenth embodiment shown in FIG. 14, the outer peripheral portion 180*a* of the washer 180 is thicker than the inner peripheral portion 180*b* of the washer 180.

The washer 180 has a flat surface adjacent to the inner peripheral surface 52*a* of the tappet body 52. A surface of the washer 180 adjacent to the roller 66 has a step 182 due to the difference in the thickness. The axial length of the roller 184 is shorter than the axial length of the bush 64 according to the difference in the thickness of the washer 180. Due to the difference in the axial length, a step 186 is formed by the roller 184 and the bush 64 corresponding to the step 182 of the washer 180.

The step 182 of the washer 180 is fitted with the step 186 formed by the roller 184 and the bush 64, such that the bush 64, the washer 180, and the roller 184 are assembled on the outer peripheral side of the pin 60.

In this state, the outer peripheral portion 180*a* of the washer 180 is sandwiched between the roller 184 and the tappet body 52, and the inner peripheral portion 180*b* of the washer 180 is sandwiched between the bush 64 and the tappet body 52. A part of the outer peripheral portion 180*a* of the washer 180, which is thicker than the inner peripheral portion 180*b*, is located on the outer periphery of the step 186.

Figure 14:
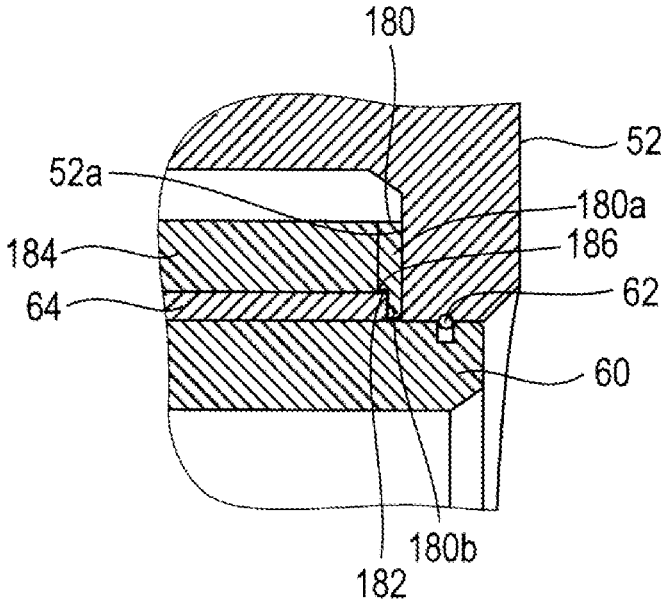
FIG. 14 is a sectional view illustrating a shape of a washer according to a tenth embodiment.

In contrast to the assembled state shown in FIG. 14, if the front surface of the washer 180 is reversed to the back side, a part of the outer peripheral portion 180*a*, which is thicker than the inner peripheral portion 180*b*, faces the side opposite to the step 186. At this time, the step 182 of the washer 180 does not fit with the step 186 formed by the roller 184 and the bush 64.

In this state, a part of the outer peripheral portion 180*a* of the washer 180, which is thicker than the inner peripheral portion 180*b*, is located radially outside the position of the inner peripheral surface 52*a* of the tappet body 52, so that the washer 180 cannot be attached to the inner peripheral side of the tappet body 52.

According to the tenth embodiment described above, the effects (1*a*) to (1*c*) of the first embodiment can be obtained by replacing the roller 66 with the roller 184 and replacing the washer 70 with the washer 180. Moreover, further effects can be obtained as follows.

Figure 15:
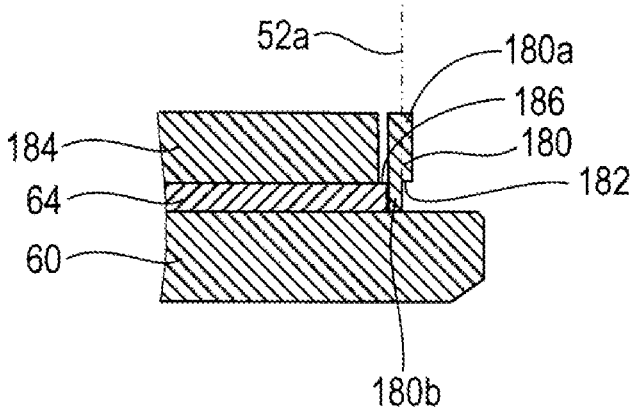
FIG. 15 is a sectional view for explaining an erroneous assembly of a washer.

(10*a*) In contrast to the assembled state shown in FIG. 14, if the washer 180 is reversed as shown in FIG. 15, the washer 180 cannot be assembled on the inner peripheral side of the tappet body 52. As a result, it is possible to restrict the washer 180 from being mistakenly assembled reversely.

Eleventh Embodiment

The fundamental configuration of the eleventh embodiment is similar to that of the first embodiment, so the difference therebetween will be described below. Note that the same reference numerals as those in the first embodiment indicate the same configuration, and refer to the preceding descriptions.

Figure 16:
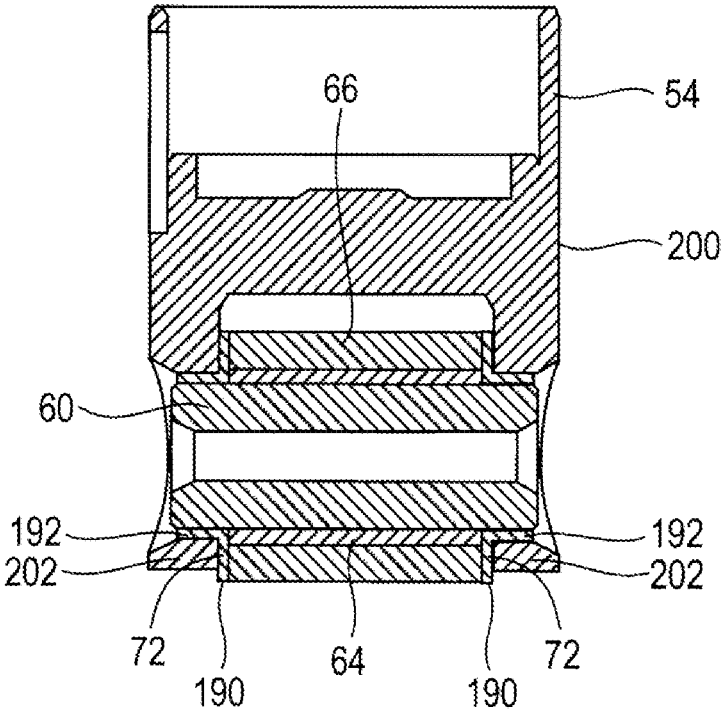
FIG. 16 is a sectional view illustrating a shape of a washer according to an eleventh embodiment.

In the first embodiment, the washer 70 is formed in a flat plate shape. In the eleventh embodiment shown in FIG. 16, the washer 190 has a circular cylindrical portion 192 that extends from the inner peripheral edge of the annular portion 72 toward the axial end portion of the pin 60, in addition to the annular portion 72 and the protrusion 74 (not shown).

The cylindrical portion 192 of the washer 190 is sandwiched between the outer peripheral surface of the pin 60 and the inner peripheral surface of the support portion 202 of the tappet body 200. Since the cylindrical portion 192 is sandwiched between the outer peripheral surface of the pin 60 and the inner peripheral surface of the support portion 202 of the tappet body 200, the inner diameter of the support portion 202 is larger than that of the support portion 56 of the first embodiment.

According to the eleventh embodiment described above, the following further effects can be obtained in addition to the effect obtained by replacing the washer 70 with the washer 190 in the effects (1*a*) to (1*c*) of the first embodiment.

(11*a*) Since the cylindrical portion 192 of the washer 190 is sandwiched between the outer peripheral surface of the pin 60 and the inner peripheral surface of the support portion 202 of the tappet body 200, the outer peripheral surface of the pin 60 and the inner peripheral surface of the support portion 202 of the tappet body 200 can be restricted from abrasion caused by the direct contact.

Twelfth Embodiment

The fundamental configuration of the twelfth embodiment is similar to that of the first embodiment, so the difference therebetween will be described below. Note that the same reference numerals as those in the first embodiment indicate the same configuration, and refer to the preceding descriptions.

Figure 17:
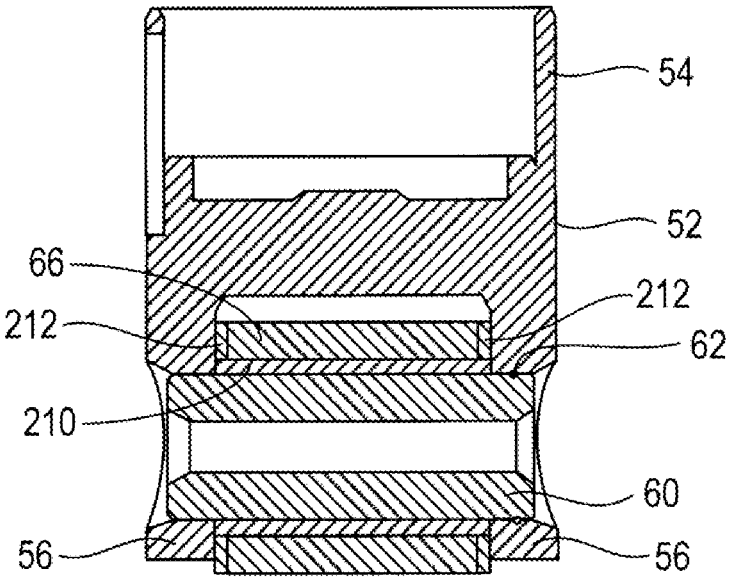
FIG. 17 is a sectional view illustrating a fitted state of a washer and a bush according to a twelfth embodiment.

In the first embodiment, the washer 70 is fitted on the outer periphery of the pin 60 and is supported by the pin 60. In the twelfth embodiment shown in FIG. 17, the washer 212 is fitted to the outer periphery of the bush 210, and the inner circumference of the washer 212 is supported by the bush 210.

The axial length of the bush 210 is longer than the bush 64 of the first embodiment, such that the bush 210 supports the washer 212 fitted to the outer circumference of the bush 210.

According to the twelfth embodiment described above, the following further effects can be obtained in addition to the effects (1*a*) to (1*c*) of the first embodiment obtained by replacing the washer 70 with the washer 212.

(12*a*) Since the pin 60 can be inserted and assembled in the inner periphery of the bush 210 while the roller 66 and the washer 212 are fitted to the outer periphery of the bush 210, the pin 60 can be easily attached to the inner periphery of the bush 210.

Thirteenth Embodiment

The fundamental configuration of the thirteenth embodiment is similar to that of the twelfth embodiment, so the difference therebetween will be described below. Note that the same reference numerals as those in the twelfth embodiment indicate the same configuration, and refer to the preceding descriptions.

Figure 18:
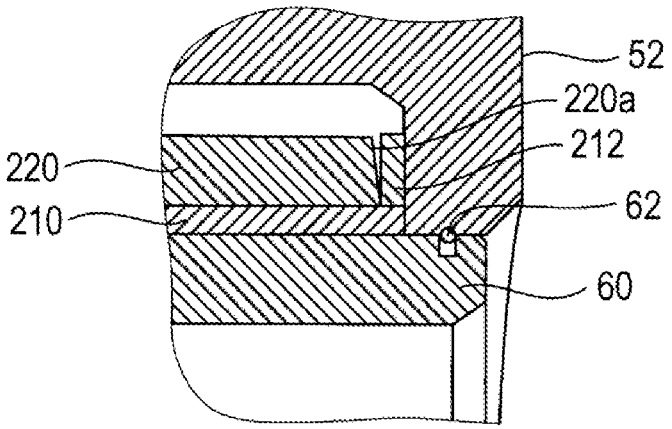
FIG. 18 is a sectional view illustrating a shape of an axial end surface of a roller according to a thirteenth embodiment.

In the twelfth embodiment, the roller 66 and the washer 212 are in flat contact with each other. In the thirteenth embodiment shown in FIG. 18, the axial end surface 220*a* of the roller 220 that comes into contact with the washer 212 is tapered so as to move away from the washer 212 from the inner peripheral side toward the outer peripheral side of the washer 212. Thus, the outer peripheral portion of the axial end surface 220*a* of the roller 220 is farther from the washer 212 than the inner peripheral portion of the axial end surface 220*a*. The distance away from the washer 212 to the outer peripheral portion of the axial end surface 220*a* may be, for example, 100 μm or less at the outermost periphery of the axial end surface 220*a*.

Since the axial end surface 220*a* of the roller 220 is formed in a tapered shape, the inner peripheral side of the axial end surface 220*a* of the roller 220 contacts the washer 212, but the outer peripheral side of the axial end surface 220*a* is restricted from contacting the washer 212.

According to the thirteenth embodiment described above, the following further effects can be obtained in addition to the effect obtained by replacing the roller 66 with the roller 220 in the twelfth embodiment.

(13*a*) Since the axial end surface 220*a* of the roller 220 that comes into contact with the washer 212 is tapered away from the washer 212, from the inner circumference side to the outer circumference side, the contact area between the axial end surface 220*a* of the roller 220 and the washer 212 decreases.

As a result, it is possible to suppress the axial end surface 220*a* of the roller 220 and the washer 212 from coming into close contact with each other, so that the rotational force that the washer 212 receives from the roller 220 can be reduced.

(13*b*) Since it is possible to suppress the outer peripheral edge of the axial end surface 220*a* of the roller 220 from contacting the washer 212 and pressing the washer 212 in the axial direction, it is possible to restrict the outer peripheral sides of the axial end surface 220*a* and the washer 212 from being worn.

Fourteenth Embodiment

The fundamental configuration of the fourteenth embodiment is similar to that of the twelfth embodiment, so the difference therebetween will be described below. Note that the same reference numerals as those in the twelfth embodiment indicate the same configuration, and refer to the preceding descriptions.

Figure 19:
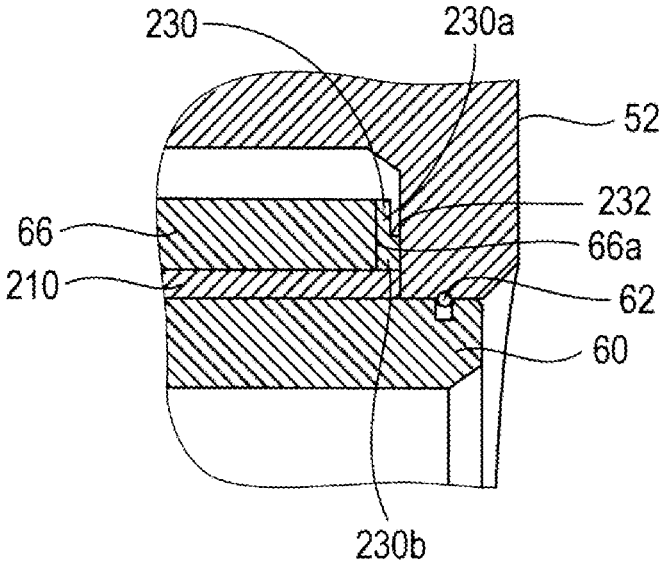
FIG. 19 is a sectional view illustrating a shape of a washer according to a fourteenth embodiment.

In the twelfth embodiment described above, the washer 212 is formed in a flat plate shape with the same thickness. In the fourteenth embodiment shown in FIG. 19, the outer peripheral portion 230*a* of the washer 230 is thinner than the inner peripheral portion 230*b*.

The surface of the washer 230 adjacent to the roller 66 is flat. A step 232 is formed on the other surface of the washer 230 opposite to the roller 66 due to the difference in the thickness.

According to the fourteenth embodiment described above, the following further effects can be obtained in addition to the effects obtained by replacing the washer 212 with the washer 230 in the twelfth embodiment.

(14*a*) Since the outer peripheral portion 230*a* of the washer 230 is thinner than the inner peripheral portion 230*b*, the outer peripheral portion 230*a* of the washer 230 is more easily deformed in the axial direction than the inner peripheral portion 230*b* when the roller 66 presses the washer 230 in the axial direction.

As a result, the force that the outer peripheral portion 230*a* of the washer 230 receives in the axial direction from the roller 66 can be reduced. Thus, the outer peripheral side of the axial end surface 66*a* of the roller 66 and the outer peripheral portion 230*a* of the washer 230 can be suppressed from wearing.

Fifteenth Embodiment

The fundamental configuration of the fifteenth embodiment is similar to that of the first embodiment, so the difference therebetween will be described below. Note that the same reference numerals as those in the first embodiment indicate the same configuration, and refer to the preceding descriptions.

Figure 20:
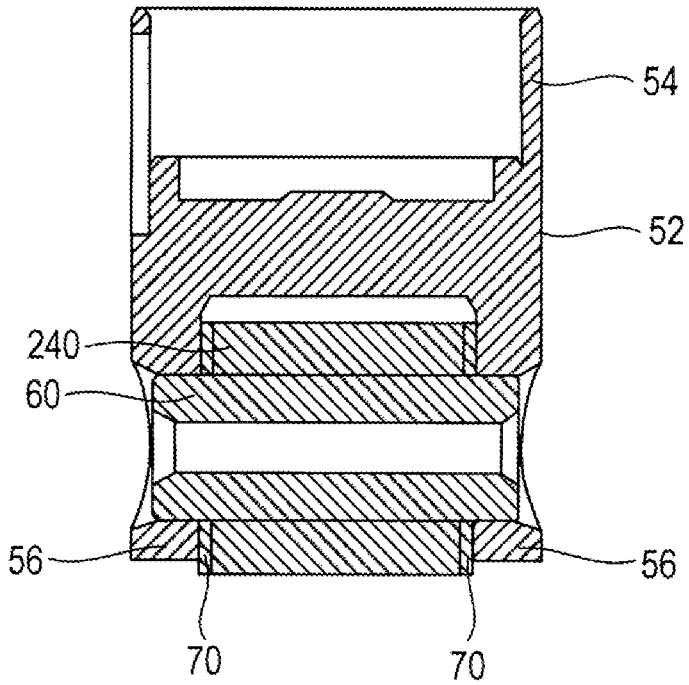
FIG. 20 is a sectional view illustrating a fitted state of a pin and a roller according to a fifteenth embodiment.

In the first embodiment, the bush 64 and the roller 66 are separate members. In the fifteenth embodiment shown in FIG. 20, the roller 240 also serves as a bush. Therefore, in the fifteenth embodiment, the inner peripheral surface of the roller 240 is in direct contact with the outer peripheral surface of the pin 60.

According to the fifteenth embodiment described above, the following further effects can be obtained in addition to the effects (1*a*) to (1*c*) of the first embodiment by replacing the roller 66 with the roller 240.

(15*a*) Since the roller 240 also functions as a bush, the number of components for forming the tappet can be reduced.

Sixteenth Embodiment

The fundamental configuration of the sixteenth embodiment is similar to that of the fifteenth embodiment, so the difference therebetween will be described below. Note that the same reference numerals as those in the fifteenth embodiment indicate the same configuration, and refer to the preceding descriptions.

Figure 21:
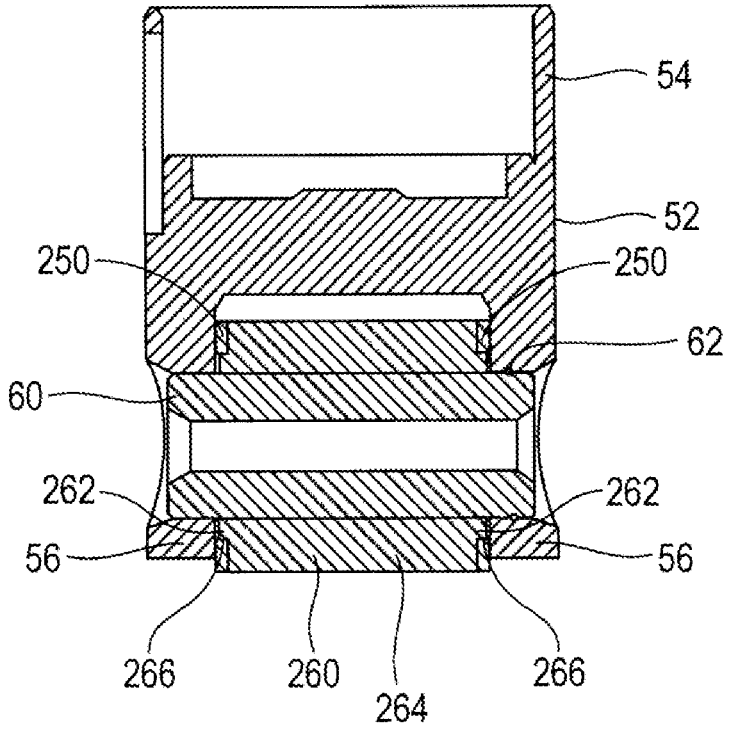
FIG. 21 is a sectional view illustrating a fitted state of a roller and a washer according to a sixteenth embodiment.

In the fifteenth embodiment, the washer 70 is fitted with the outer periphery of the pin 60. In the sixteenth embodiment shown in FIG. 21, the washer 250 is fitted to the outer periphery of the roller 260. The inner circumference of the washer 250 is supported by the roller 260.

Specifically, the roller 260 has a small diameter portion 262 and a large diameter portion 264 having an outer diameter larger than that of the small diameter portion 262. The small diameter portion 262 is formed on both sides in the axial direction to support the washer 250. The large diameter portion 264 is located between the small diameter portions 262. A step 266 is formed by the difference in diameter between the small diameter portion 262 and the large diameter portion 264. The roller 260 is fitted to the outer peripheral side of the pin 60 with an axial length including the small diameter portion 262 and the large diameter portion 264.

According to the sixteenth embodiment described above, the following further effects can be obtained in addition to the effect of the fifteenth embodiment obtained by replacing the washer 70 with the washer 250 and replacing the roller 240 with the roller 260.

(16*a*) Since the pin 60 can be easily inserted and assembled in the inner circumference of the roller 260 in the state where the washer 250 is fitted with the outer circumference of the small diameter portion 262 of the roller 260.

(16*b*) Since the roller 260 is fitted on the outer peripheral side of the pin 60 with the axial length including the small diameter portion 262 and the large diameter portion 264, the axial contact length becomes longer between the inner peripheral surface of the roller 260 and the outer peripheral surface of the pin 60. As a result, when the roller 260 rotates while being in contact with the pin 60, it is possible to suppress seizure between the outer peripheral surface of the pin 60 and the inner peripheral surface of the roller 260.

Seventeenth Embodiment

The fundamental configuration of the seventeenth embodiment is similar to that of the first embodiment, so the difference therebetween will be described below. Note that the same reference numerals as those in the first embodiment indicate the same configuration, and refer to the preceding descriptions.

Figure 22:
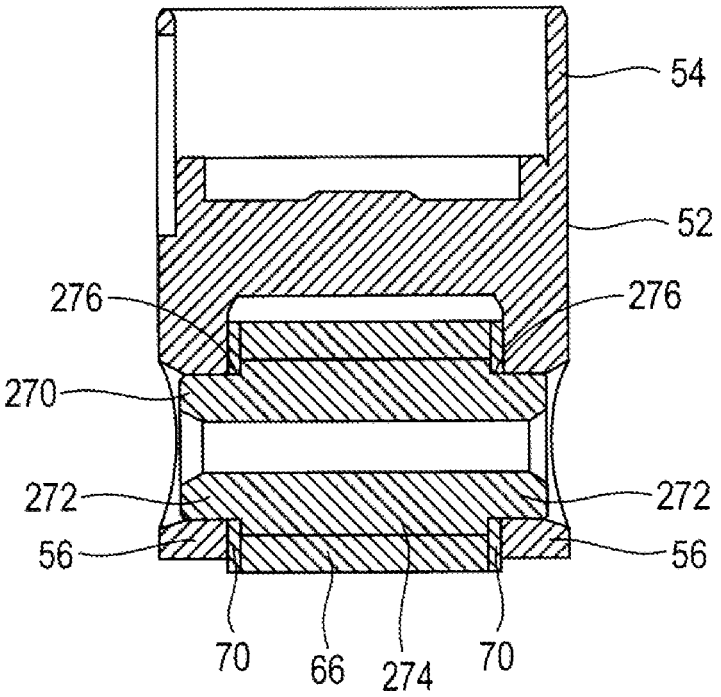
FIG. 22 is a sectional view illustrating a fitted state of a pin and a washer according to according to a seventeenth embodiment.

In the first embodiment, the pin 60 and the bush 64 are separate members. In the seventeenth embodiment shown in FIG. 22, the pin 270 also serves as a bush.

Specifically, the pin 270 includes a small diameter portion 272 formed on both sides in the axial direction to be supported by the support portion 56 of the tappet body 52, and a large diameter portion 274 having an outer diameter larger than that of the small diameter portion 272. A step 276 is formed by the difference in diameter between the small diameter portion 272 and the large diameter portion 274. The roller 66 is fitted on the outer peripheral side of the large diameter portion 274.

The washer 70 is installed between the inner peripheral surface 52*a* of the tappet body 52 and the axial end surfaces of the roller 66 and the step 276. The washer 70 is fitted to the outer circumference of the small diameter portion 272 of the pin 270, and the inner circumference of the washer 70 is supported by the small diameter portion 272.

According to the seventeenth embodiment described above, the following further effects can be obtained in addition to the effects (1*a*) to (1*c*) of the first embodiment.

(17*a*) Since the pin 270 also serves as a bush, the number of components for forming the tappet can be reduced.

(17*b*) Since the washer 70 is installed between the inner peripheral surface 52*a* of the tappet body 52 and the axial end surface of the step 276, even if the pin 60 receives a force in the axial direction, the step 276 stops the axial movement of the washer 70. As a result, the C-ring 62 installed to suppress the axial movement of the pin 60 in the first embodiment is unnecessary.

OTHER EMBODIMENTS

Although the embodiments have been described above, the present disclosure is not limited to the above embodiments, and can be implemented with various modifications.

(18*a*) In the above embodiments, the washer is installed on both axial sides of the roller and is located between the inner peripheral surface of the tappet body and the roller. Alternatively, the washer may be installed only on one side in the axial direction of the roller. For example, when the roller presses the washer toward the inner peripheral surface of the tappet body only in one direction, the washer may be installed at only one corresponding side where the washer is pressed by the roller toward the inner peripheral surface of the tappet body.

(18*b*) In the above embodiments, the washer has two protrusions that are stopped by the stopper of the tappet body in the rotational direction. Alternatively, the washer may have one protrusion. For example, when the rotational direction of the roller is one direction, the washer may have one protrusion.

(18*c*) In the thirteenth embodiment, the axial end surface 220*a* of the roller 220 is tapered away from the washer 212 as extending from the inner peripheral side toward the outer peripheral side, so that the outer peripheral portion of the axial end surface 220*a* is away from the washer 212. Alternatively, the axial end surface of the washer may be formed in a convex arc shape so that the outer peripheral portion of the axial end surface of the washer is separated from the washer.

(18*d*) A plurality of functions of one component in the above-described embodiment may be realized by a plurality of component s, or one function of one component may be realized by a plurality of components. Further, a plurality of functions executed by a plurality of components may be realized by one component, or a single function realized by a plurality of components may be realized by a single component. A part of the configuration of the above embodiments may be omitted. At least a part of the configuration of the described above embodiment may be added to or replaced with another configuration of the described above embodiment.

(18*e*) The present disclosure can be realized in various forms such as a system having the fuel injection pump as a component, in addition to the fuel injection pump described above.

What is claimed is:

1. A fuel injection pump comprising:

a tappet configured to reciprocate by rotation of a cam;

a cylinder that supports the tappet to reciprocate; and a plunger configured to reciprocate with the tappet to discharge pressurized fuel, wherein the tappet includes a tappet body supported by the cylinder to reciprocate, a pin supported on both sides in an axial direction of the pin by the tappet body, a roller rotatably fitted to an outer peripheral side of the pin, the roller rotating and reciprocating by rotation of the cam to cause the plunger and the tappet body to reciprocate, and a washer disposed between at least one end surface of the roller in the axial direction and an inner peripheral surface of the tappet body, the washer has at least one protrusion to be in contact with a stopper of the tappet body in either of two rotational directions; and wherein a groove is formed on an end surface of the washer adjacent to the roller to circulate lubricating oil.

2. The fuel injection pump according to claim 1, wherein the washer is formed in an annular shape, and an inner circumference of the washer is supported by the pin, the roller, or a bush fitted to the outer peripheral side of the pin to rotatably support the roller.

3. The fuel injection pump according to claim 1, wherein an end surface of the washer facing the roller has an abrasion resistance coating.

4. The fuel injection pump according to claim 1, wherein a length from a center of the washer to an end position of the washer adjacent to the cam is shorter than a length from the center of the washer to an end position of the washer opposite from the cam.

5. The fuel injection pump according to claim 1, wherein ends of the washer in a radial direction of the tappet body are located at a radially inner side of ends of the tappet body in the radial direction of the tappet body.

6. The fuel injection pump according to claim 1, wherein the washer has (i) a first side having a first outer shape of the washer as viewed from a side adjacent to the roller and (ii) a second side having a second outer shape of the washer as viewed from an opposite side of the roller; and the first outer shape and the second outer shape are different from each other.

7. The fuel injection pump according to claim 1, wherein the washer is elastic in a thickness direction.

8. The fuel injection pump according to claim 1, wherein an outer peripheral portion of the washer is thinner than an inner peripheral portion of the washer.

9. The fuel injection pump according to claim 1, wherein the roller has an end surface in the axial direction, and an outer peripheral portion of the end surface is separated from the washer.

10. The fuel injection pump according to claim 1, wherein the washer has a cylindrical portion extended in the axial direction, and the cylindrical portion is located between an outer peripheral surface of the pin and a support portion of the tappet body that supports the outer peripheral surface of the pin.

11. The fuel injection pump according to claim 1, further comprising: a bush fitted to the outer peripheral side of the pin to rotatably support the roller, wherein an inner circumference of the washer is supported by the bush.

12. The fuel injection pump according to claim 1, wherein the roller has a small diameter portion and a large diameter portion larger in diameter than the small diameter portion, the small diameter portion being located adjacent to an inner peripheral surface of the tappet body at least one end side in the axial direction, and the washer is formed in an annular shape, and the small diameter portion of the roller supports an inner circumference of the washer.

13. The fuel injection pump according to claim 1, wherein the pin has a small diameter portion and a large diameter portion larger in diameter than the small diameter portion, a support portion of the tappet body supports an outer peripheral surface of the small diameter portion at least one end side in the axial direction, the roller is fitted on an outer periphery of the large diameter portion, and the washer is formed in an annular shape, and the small diameter portion of the pin supports an inner circumference of the washer.

* * * * *